US007503385B2

(12) United States Patent
Tips et al.

(10) Patent No.: US 7,503,385 B2
(45) Date of Patent: Mar. 17, 2009

(54) SINGLE LINE CONTROL MODULE FOR WELL TOOL ACTUATION

(75) Inventors: Timothy R. Tips, Spring, TX (US); Robert Gissler, Spring, TX (US)

(73) Assignee: Welldynamics, Inc., Spring, TX (US)

( * ) Notice: Subject to any disclaimer, the term of this patent is extended or adjusted under 35 U.S.C. 154(b) by 232 days.

(21) Appl. No.: 11/430,817

(22) Filed: May 9, 2006

(65) Prior Publication Data

US 2006/0254763 A1 Nov. 16, 2006

(30) Foreign Application Priority Data

May 13, 2005 (WO) ..... PCT/US2005/016971

(51) Int. Cl.
*E21B 34/10* (2006.01)

(52) U.S. Cl. ..... 166/72; 166/319

(58) Field of Classification Search ..... 166/72, 166/375, 381, 319

See application file for complete search history.

(56) References Cited

U.S. PATENT DOCUMENTS

| | | | |
|---|---|---|---|
| 2,770,308 | A | 11/1956 | Saurenman |
| 3,763,885 | A | 10/1973 | Sussman |
| 4,132,205 | A | 1/1979 | Merritt |
| 4,180,239 | A | 12/1979 | Valukis |
| 4,660,647 | A | 4/1987 | Richart |
| 4,915,168 | A | 4/1990 | Upchurch |
| 5,238,070 | A | 8/1993 | Schultz et al. |
| 5,564,501 | A | 10/1996 | Strattan et al. |
| 5,746,413 | A | 5/1998 | Goloff |
| 5,897,095 | A | 4/1999 | Hickey |
| 5,906,220 | A | 5/1999 | Thompson |
| 6,247,536 | B1 | 6/2001 | Leismer et al. |
| 6,253,857 | B1 | 7/2001 | Gano |

(Continued)

FOREIGN PATENT DOCUMENTS

FR 2270458 12/1975

(Continued)

OTHER PUBLICATIONS

International Preliminary Report on Patentability and Written Opinion issued for PCT/US05/016971 dated Nov. 22, 2007 (6 pages).

(Continued)

*Primary Examiner*—Hoang Dang
(74) *Attorney, Agent, or Firm*—Smith IP Services, P.C.

(57) ABSTRACT

A single line control module for well tool actuation. A well tool control system includes an actuator, a control module for controlling pressure applied to the actuator, and a single line extending between the control module and a remote location, elevated pressure being applied to the line and exhausted from the line at the remote location to operate the actuator. Another well tool control system includes an actuator having first and second chambers, a line for applying elevated pressure to the actuator to operate the actuator, and a control module including an accumulator, and a valve. The valve has a first position in which the line is connected to the first chamber and the accumulator is connected to the second chamber, and a second position in which the line is connected to the second chamber and the accumulator is connected to the first chamber.

20 Claims, 14 Drawing Sheets

U.S. PATENT DOCUMENTS

| | | | | |
|---|---|---|---|---|
| 6,276,458 | B1 | 8/2001 | Malone | |
| 6,502,640 | B2 | 1/2003 | Rayssiguier et al. | |
| 6,536,530 | B2 | 3/2003 | Schultz et al. | |
| 6,585,051 | B2 | 7/2003 | Purkis et al. | |
| 6,988,554 | B2 | 1/2006 | Bodine et al. | |
| 7,013,980 | B2 | 3/2006 | Purkis et al. | |
| 2002/0014338 | A1 * | 2/2002 | Purkis et al. | 166/375 |
| 2004/0216884 | A1 * | 11/2004 | Bodine et al. | 166/335 |
| 2005/0178560 | A1 | 8/2005 | Johansen et al. | |

FOREIGN PATENT DOCUMENTS

| | | |
|---|---|---|
| GB | 1135895 | 12/1968 |
| GB | 1345867 | 2/1974 |
| GB | 2335216 | 9/1999 |

OTHER PUBLICATIONS

Search Report for PCT/US04/21934.
Search Report for PCT/US05/16971.
"BOT 'SLS'(One Line Module)", 1 pg., undated.
"BOT Hydraulic Single Line Control Module", 1pg., undated.
"BOT Multi-Drop Module", 1 pg., undated.
"BOT Hydraulic Multi-Drop Control Module", 1 pg., undated.
"BOT 'HCM-A'(Hydraulic Choke)", 3 pgs., undated.
"SLB 'TRFC-HR'Hydraulic Choke", 1 pg., undated.
"Schlumberger 'TRFC-HN'Control Mechanism", 1 pg., undated.
"SLB TRFC-HN"Hydraulic Choke, 1 pg., undated.

* cited by examiner

SINGLE LINE CONTROL MODULE FOR WELL TOOL ACTUATION

CROSS-REFERENCE TO RELATED APPLICATION

The present application claims the benefit under 35 USC §119 of the filing date of International Application No. PCT/US2005/016971, filed on May 13, 2005, the entire disclosure of which is incorporated herein by this reference.

BACKGROUND

The present invention relates generally to equipment utilized and methods performed in conjunction with a subterranean well and, in an embodiment described herein, more particularly provides a single line control module for well tool actuation.

A variety of well tools are available which may be operated or actuated by application of pressure. For example, a production valve or choke may be opened or closed by applying pressure to a control line extending to a remote location, such as the earth's surface or another location in the well. Many other types of well tools and pressure application methods are available, as well.

In instances where a well tool is operated by control line pressure, it is known to use a separate control line for each mode of operation. For example, a downhole valve may be opened by increasing pressure on one control line, and the valve may be closed by increasing pressure on another control line. However, the use of multiple control lines increases the cost and time required to complete an installation and in some applications, such as subsea wells, the number of control lines or umbilicals is severely limited.

For these reasons, there is a need to reduce the number of control lines used to operate well tools. Some systems have been proposed in the past which use a single control line to operate a downhole well tool. However, for the most part these systems have been unduly complex and, thus, unreliable and expensive.

Therefore, it may be seen that a need exists for improvements in operating downhole well tools using a single control line.

SUMMARY

In carrying out the principles of the present invention, in accordance with an embodiment thereof, a single line well tool control system is provided which satisfies the above need in the art. The system includes a control module which is connected to a well tool actuator, and which is responsive to pressure in a single control line to control operation of the actuator. The control module is of an uncomplicated and reliable design for downhole use.

In one aspect of the invention, a well tool control system is provided which includes an actuator and a control module for controlling pressure applied to the actuator. A single line extends between the control module and a remote location. Elevated pressure is applied to the line and exhausted from the line at the remote location to operate the actuator.

In another aspect of the invention, a well tool control system is provided which includes an actuator including first and second chambers, and a line for applying elevated pressure to the actuator to operate the actuator. A control module of the system includes an accumulator, and a valve. The valve has a first position in which the line is connected to the first chamber and the accumulator is connected to the second chamber, and a second position in which the line is connected to the second chamber and the accumulator is connected to the first chamber.

In a further aspect of the invention, a well tool control system is provided which includes an actuator including a piston separating first and second chambers, the actuator operating by relative displacement between the piston and the first and second chambers. A control module connects the first chamber to a source of elevated pressure in response to relative displacement of the piston in a first direction. The control module also connects the second chamber to the source of elevated pressure in response to relative displacement of the piston in a second direction opposite to the first direction.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
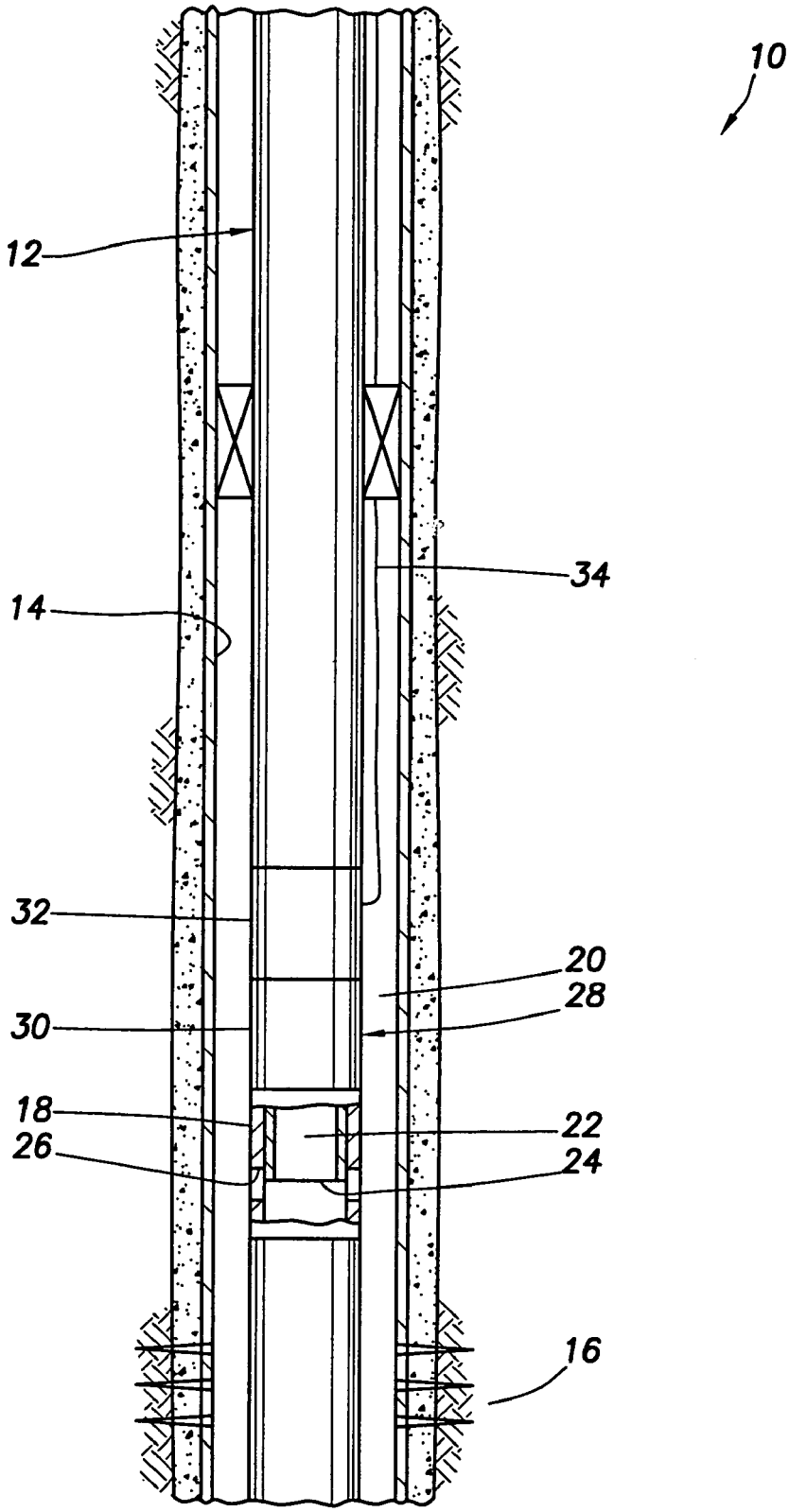
FIG. 1 is a schematic partially cross-sectional view of a well tool control system embodying principles of the present invention.

Representatively illustrated in FIG. 1 is a well tool control system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

As depicted in FIG. 1, a tubular string 12 (such as a production tubing string or other type of tubing string) has been installed in a wellbore 14 which intersects an earth formation 16. Fluids (such as oil and/or gas) from the formation 16 are produced to the surface through the tubular string 12. This flow between the formation 16 and the tubular string 12 is regulated by means of a well tool 28 interconnected in the tubular string.

The well tool 28 includes a flow control device 18, which may be a valve, in which case flow between an annulus 20 and an interior passage 22 of the tubular string 12 may be selectively permitted or prevented by operation of the valve. The flow control device 18 may alternatively (or in addition) be a choke, in which case the rate of fluid flow between the annulus 20 and the passage 22 may be varied between maximum and minimum limits. These maximum and minimum limits could correspond to fully open and fully closed positions of a closure member 24 of the flow control device 18.

The closure member 24 illustrated in FIG. 1 is configured as a generally tubular sleeve for permitting, preventing and/or otherwise regulating flow through ports 26 formed through a sidewall of the flow control device 18. However, it should be clearly understood that other types of closure members (such as plugs, flappers, balls, cages, needles, etc.) may be used in a flow control device without departing from the principles of the invention.

It is also not necessary for a flow control device to be used, since the principles of the invention may be used in controlling operation of other types of well tools (such as gravel packing tools, packers, chemical or gas injection tools, perforating tools, drilling tools, etc.). Furthermore, it is not necessary for fluids to be produced from a well using the invention, since fluids could alternatively (or also) be injected into the well, transferred from one formation to another downhole, etc.

The well tool 28 depicted in FIG. 1 also includes an actuator 30 for operating the flow control device 18. The actuator 30 is used to displace the closure member 24 as desired to close or open the ports 26, or to permit a desired rate of fluid flow through the ports. As illustrated in FIG. 1, the actuator 30 has displaced the closure member 24 to a position at which only about half of the flow area of the ports 26 is available for flow therethrough.

In one important feature of the invention, the tubular string 12 also includes a control module 32. The control module 32 is preferably interconnected between the actuator 30 and a single control line 34 extending to a remote location. The control line 34 is depicted in FIG. 1 as extending along an exterior of the tubular string 12, but the control line could be completely or partially formed in a sidewall of the tubular string, and/or the control line could extend within the interior passage 22 of the tubular string.

One important benefit of the control module 32 is that it permits the well tool 28 to be operated using only the single control line 34. Thus, in the example shown in FIG. 1, the closure member 24 may be displaced downward to close off the ports 26, displaced upward to open the ports, and/or displaced to an intermediate position between fully open and fully closed, using only the single control line 34. Another important benefit of the control module 32 is that it is able to accomplish this result with a construction that is relatively uncomplicated, reliable and economical.

Although the control module 32 is depicted in FIG. 1 as being separate from the actuator 30 and the flow control device 18, it will be readily appreciated that many other configurations are possible. For example, the control module 32 could be combined with the actuator 30, or the control module actuator and flow control device 18 could be combined in the well tool 28, etc. Thus, the principles of the invention are not limited to the specific configurations of the examples illustrated in the drawings and described here.

Figure 2:
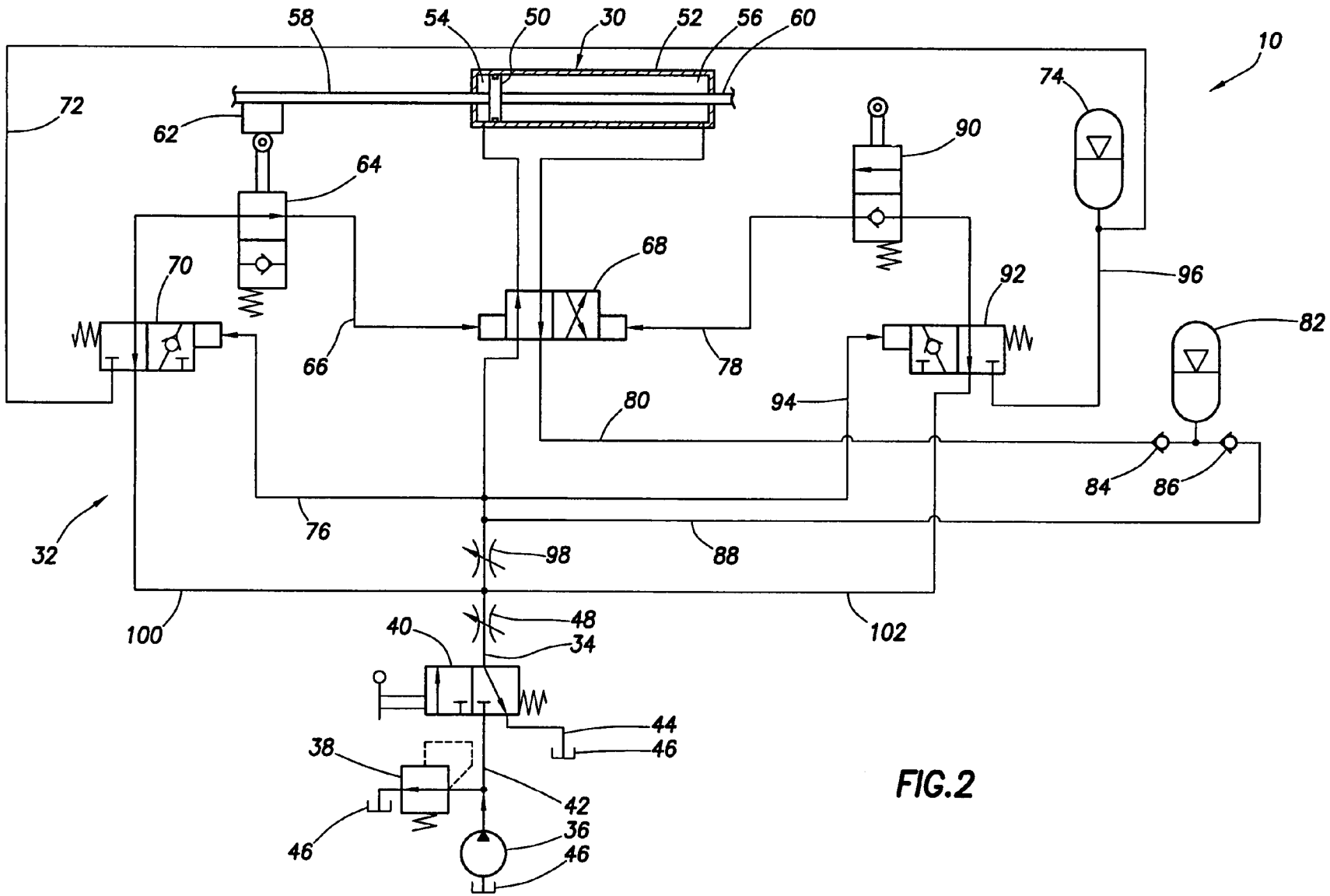
FIGS. 2-11 are schematic hydraulic circuit diagrams of the system of FIG. 1, the system being shown in various stages of operation.

Referring now to FIG. 2, a schematic hydraulic circuit diagram is illustrated, showing one possible configuration of the system 10. It may be seen from FIG. 2 that the control module 32 is made up of conventional hydraulic circuit components (although uniquely configured and interconnected to accomplish the objectives of the invention), and as a result the control module can be readily constructed using proven high quality, reliable components.

At a lower portion of FIG. 2, components which are connected to the control module 32 via the control line 34 are illustrated. These components may be positioned at a surface location or at another remote location. The components include a pump 36, a pressure regulator 38, a shuttle valve 40, an input line 42, an exhaust line 44 and a reservoir 46. Of course, other components, other types of components and/or other combinations of components may be used without departing from the principles of the invention.

The shuttle valve 40 is illustrated as a manually actuated spring biased valve. The valve 40 could be otherwise actuated (such as by pilot pressure, electrical solenoid, etc.) and/or otherwise biased (such as using gas pressure, unbiased, etc.) in keeping with the principles of the invention. As depicted in FIG. 2, the valve 40 is biased toward a position in which the exhaust line 44 is connected to the control line 34, and the input line 42 is closed off at the valve.

In this position of the valve 40, pressure generated by the pump 36 is not applied to the control line 34, and excess pressure above a predetermined level is bled off from the input line 42 to the reservoir 46 by the pressure regulator 38. Any pressure above hydrostatic in the control line 34 is bled off via the exhaust line 44 to the reservoir 46.

Note that the control line 34 presents a significant restriction to flow therethrough, since the control line may be many hundreds of meters long, and this is schematically represented by a restrictor 48 in FIG. 2. Thus, pressure in the control line 34 is not instantaneously bled off when the valve 40 is in the position depicted in FIG. 2. Instead, some significant period of time may be required to reduce pressure in the control line 34 to hydrostatic when the valve 40 is moved to the position shown in FIG. 2.

The actuator 30 is depicted in FIG. 2 at an upper portion of the hydraulic circuit diagram as including a piston 50 in a cylinder 52. The piston 50 divides the cylinder 52 into separate chambers 54, 56. Rods 58, 60 are connected to the piston 50 and extend outwardly from the cylinder 52.

It should be clearly understood that the actuator 30 as schematically illustrated in FIG. 2 is used merely as a representation of any of a wide variety of possible actuator configurations which may be used in keeping with the principles of the invention. It is not necessary for a piston in a cylinder to be used, since many other configurations may be desirable in certain situations. For example, an annular piston in a bore, or another type of actuator may be used. It is also not necessary for a piston to displace in the actuator 30, since a piston could remain motionless while a cylinder or other member displaces relative to the piston, etc.

When the actuator 30 is connected to the flow control device 18, the closure member 24 may be connected to one or both of the rods 58, 60, so that as the piston 50 displaces the closure member also displaces. Of course, the closure member 24 could be connected to another component of the actuator 30, such as the cylinder 52, or connected directly to the piston 50, etc. Any manner of connecting the actuator 30 to the closure member 24 (or any other component of the well tool 28) may be used in keeping with the principles of the invention.

As depicted in FIG. 2, the piston 50 is positioned to the left in the cylinder 52. This position of the piston 50 could correspond to a closed position of the closure member 24, preventing flow through the ports 26. Note that this position of the piston 50 extends the rod 58 outwardly to its maximum extent from the cylinder 52.

In this position of the rod 58, a device 62 carried on the rod depresses a manually actuated spring biased shuttle valve 64 of the control module 32. As with the valve 40 described above, the valve 64 may be of any configuration and actuated in any manner in keeping with the principles of the invention.

The device 62 could be a projection or shoulder formed on, or attached to, the rod 58 or another component of the actuator 30. For example, if the cylinder 52 displaces instead of the piston 50, the device 62 could be formed on, or attached to, the cylinder.

It is also not necessary for the device 62 to depress the valve 64. The device 62 could instead be a depression or a recess which allows the valve 64 to extend when the piston 50 is in the position depicted in FIG. 2. Alternatively, the valve 64 could be magnetically or hydraulically actuated, in which case the device 62 could be, for example, a magnet, ferrous material or another valve (such as a pilot valve) used to actuate the valve 64. As other alternatives, the device 62 could electrically, thermally, optically or otherwise actuate the valve 64. Thus, it is preferred that the valve 64 be actuated by a component of the actuator 30 when the piston 50 has been fully displaced to the left relative to the cylinder 52, but the specific manner in which the valve is actuated can be altered without departing from the principles of the invention.

In the position of the valve 64 shown in FIG. 2, a pilot line 66 connected to a pilot of a pilot operated shuttle valve 68 is open to flow in both directions through the valve 64. Note, however, that if the rod 58 is displaced to the right so that the device 62 no longer depresses the valve 64, the valve will shift to a position in which flow through the pilot line 66 will only be permitted in a direction away from the valve 68 (i.e., pressure cannot be increased in the pilot line 66, but pressure can be bled from the pilot line 66).

A separate spring biased pilot operated shuttle valve 70 is interconnected between the valve 64 and the control line 34. As with the other valves 40, 64, 68 described above, the valve 70 may be any type of valve. In the position of the valve 70 depicted in FIG. 2, the pilot line 66 is in communication with the control line 34. Thus, pressure in the pilot line 66 can be bled off via the valves 64, 70 to the control line 34.

The valve 70 as shown in FIG. 2 also closes off an accumulator line 72 which extends to a pressure accumulator 74. In one important feature of the control module 32, the accumulator 74 stores pressure downhole, permitting that pressure to be utilized later, as described in further detail below.

Note that if pressure is applied to a pilot line 76 connected to the valve 70, the valve will shift to a position in which the pilot line 66 will be disconnected from the control line 34, but the pilot line 66 will be connected to the accumulator line 72. In this position, flow from the pilot line 66 to the accumulator 74 via the accumulator line 72 is permitted, but flow in an opposite direction through the valve 70 is prevented. Thus, pressure can be bled from the pilot line 66 to the accumulator 74 via the valve 70, but pressure cannot be applied to the pilot line from the accumulator in this shifted position of the valve.

The pilot line 76 is connected to the control line 34. Therefore, if the valve 40 is operated to permit the pump 36 to apply pressure to the control line 34, the valve 70 will shift to connect the pilot line 66 to the accumulator 74 as described above.

The shuttle valve 68 is dual-pilot operated, having the pilot line 66 connected to one side of the valve and another pilot line 78 connected to an opposite side of the valve. When pressure in the pilot line 66 exceeds pressure in the pilot line 78, the valve 68 will be in the position shown in FIG. 2. In this position, the chamber 54 of the actuator 30 is connected to the control line 34, and the chamber 56 is connected to an accumulator line 80.

The accumulator line 80 extends from the valve 68 to another pressure accumulator 82. In another important feature of the invention, the accumulator 82 is used to store pressure in the control module 32 for later use in exhausting fluid from the control module through the control line 34, as described in further detail below.

Check valves 84, 86 permit fluid to enter the accumulator 82 only from the accumulator line 80, and permit fluid to be exhausted from the accumulator only to the control line 34. Thus, pressure applied to the control line 34 is not applied to the accumulator 82, even though the accumulator is connected to the control line via an exhaust line 88.

Note that, if pressure in the pilot line 78 exceeds pressure in the pilot line 66, the valve 68 will shift to a position in which the chamber 56 is connected to the control line 34, and the chamber 54 is connected to the accumulator line 80. The pilot line 78 is connected to a manually operated spring biased shuttle valve 90 which is similar to the valve 64. However, the valve 90 is actuated when the piston 50 travels to the right, as described below.

In the position shown in FIG. 2, the valve 90 permits pressure in the pilot line 78 to be bled off through the valve, but does not permit pressure to be applied to the pilot line. If the valve 90 is depressed (as shown for the valve 64 in FIG. 2), then pressure may be either applied to or bled off from the pilot line 78 through the valve.

The valve 90 is connected to a pilot operated spring biased shuttle valve 92. The valve 92 is similar to the valve 70 described above. A pilot line 94 extends from the valve 92 to the control line 34. An accumulator line 96 extends from the valve 92 to the accumulator 74.

In the position shown in FIG. 2, the valve 92 connects the pilot line 78 to the control line 34. Thus, pressure in the pilot line 78 may be bled off to the control line 34 through the valve 92. The accumulator line 96 is closed off at the valve 92.

However, if elevated pressure exists in the control line 34, this pressure will be applied to the pilot line 94 and the valve 92 will shift to a position in which the pilot line 78 is disconnected from the control line 34 and instead connected to the accumulator line 96. The valve 92 in this position will permit pressure to be bled off from the pilot line 78 to the accumulator line 96.

It may now be appreciated that FIG. 2 depicts the system 10 after the piston 50 has been displaced fully to the left, actuating the valve 64 and permitting the pilot line 66 to be in direct communication with the control line 34. Fluid in the accumulator 82 is exhausted via the exhaust line 88, control line 34, valve 40 and exhaust line 44 to the reservoir 46. The accumulator lines 72, 96 are closed off at the valves 70, 92.

Figure 3:
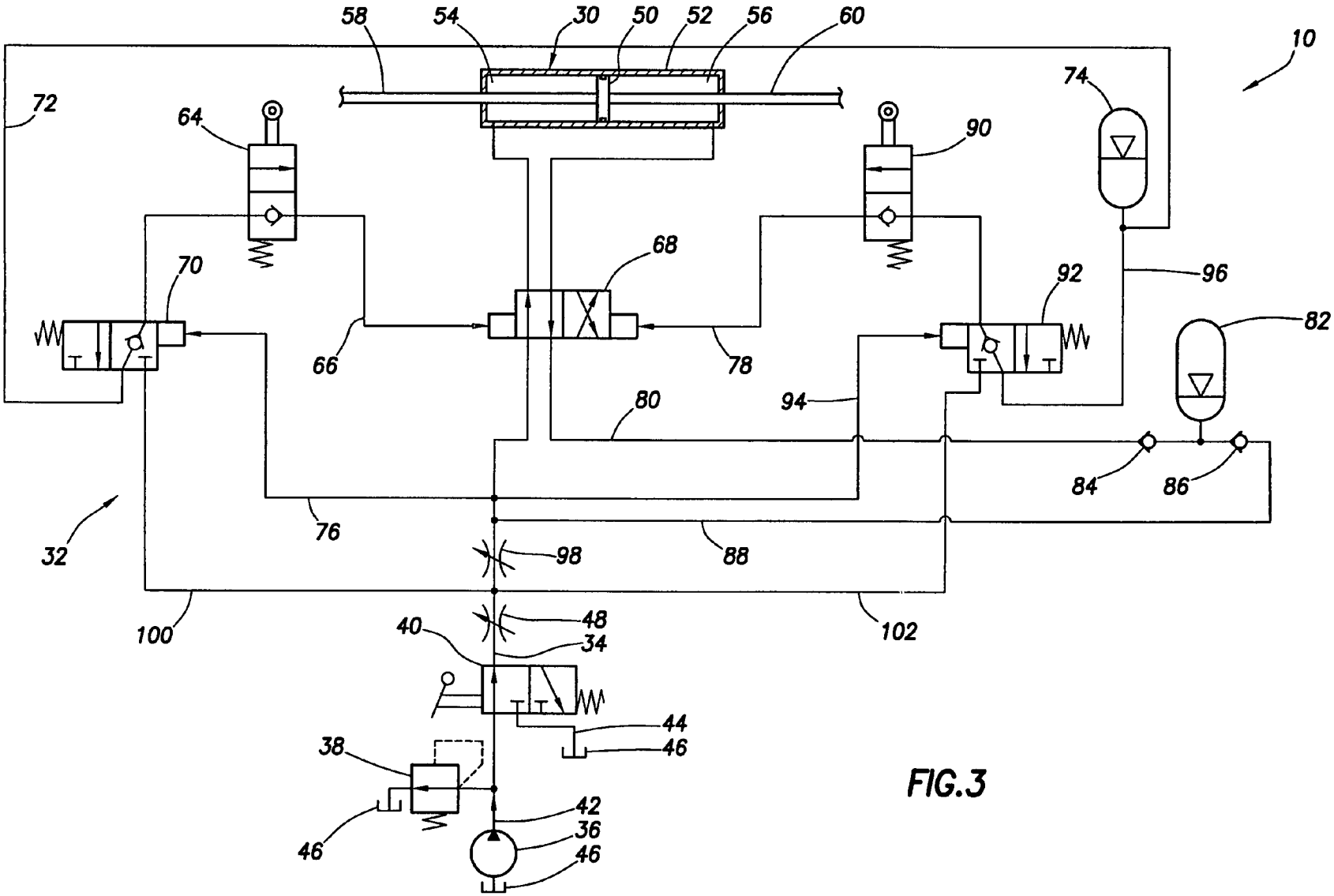

Referring additionally now to FIG. 3, the system 10 is depicted after the valve 40 has been actuated to apply pressure from the pump 36 to the control line 34. The increased pressure in the control line 34 is communicated to the pilot lines 76, 94. This shifts the valves 70, 92 to positions in which the pilot lines 66, 78 are connected to the accumulator 74.

Note, however, that the control module 32 includes a restrictor 98 in the control line 34. The restrictor 98 is positioned between the connection between the control line 34 and the pilot lines 76, 94, and the connection between the control line and lines 100, 102 extending to the valves 70, 92. The lines 100, 102 are in communication with the respective pilot lines 66, 78 prior to the valves 70, 92 shifting in response to increased pressure in the control line 34. That is, the restrictor 98 ensures that increased pressure in the control line 34 is applied to the appropriate one of the pilot lines 66, 78 prior to the valves 70, 92 shifting in response to increased pressure in the pilot lines 76, 94.

Note that in FIG. 2 the pilot line 66 is in direct communication with the control line 34 via the valves 64, 70 and line 100. However, a check valve in the valve 90 prevents pressure applied to the control line 34 from being communicated to the pilot line 78. Thus, as pressure is increased in the control line 34, greater pressure will exist in the pilot line 66 than in the pilot line 78, thereby maintaining the valve 68 in its position as shown in FIG. 2.

Eventually, the restrictor 98 will permit sufficient pressure to build up in the control line 34 and the pilot lines 76, 94 downstream of the restrictor to shift the valves 70, 92 to their positions as depicted in FIG. 3. In these positions of the valves 70, 92, pressure in the pilot lines 66, 78 may bleed off to the accumulator lines 72, 96.

With the valve 68 in the position shown in FIG. 3, increased pressure in the control line 34 is communicated to the chamber 54 of the actuator 30, thereby displacing the piston 50 to the right. This displacement of the piston 50 may be used to displace the closure member 24 of the flow control device 18 upward to partially open the ports 26. Displacement of the piston 50 could be halted at this point (by shifting the valve 40 back to its FIG. 2 position) to leave the closure member 24 between its fully open and fully closed positions, thereby choking the flow through the ports 26, if desired.

As the piston 50 displaces to the right, fluid in the chamber 56 is discharged from the cylinder 52 and through the valve 68 into the accumulator line 80. This fluid passes through the check valve 84 and into the accumulator 82, thereby pressurizing the accumulator. The check valve 86 prevents the increased pressure in the control line 34 from pressurizing the accumulator 82.

Displacement of the piston 50 to the right also displaces the rod 58, causing the device 62 to no longer depress the valve 64. Pressure may now be bled off from the pilot line 66, but pressure may not be applied to the pilot line 66 through the valve 64.

Figure 4:
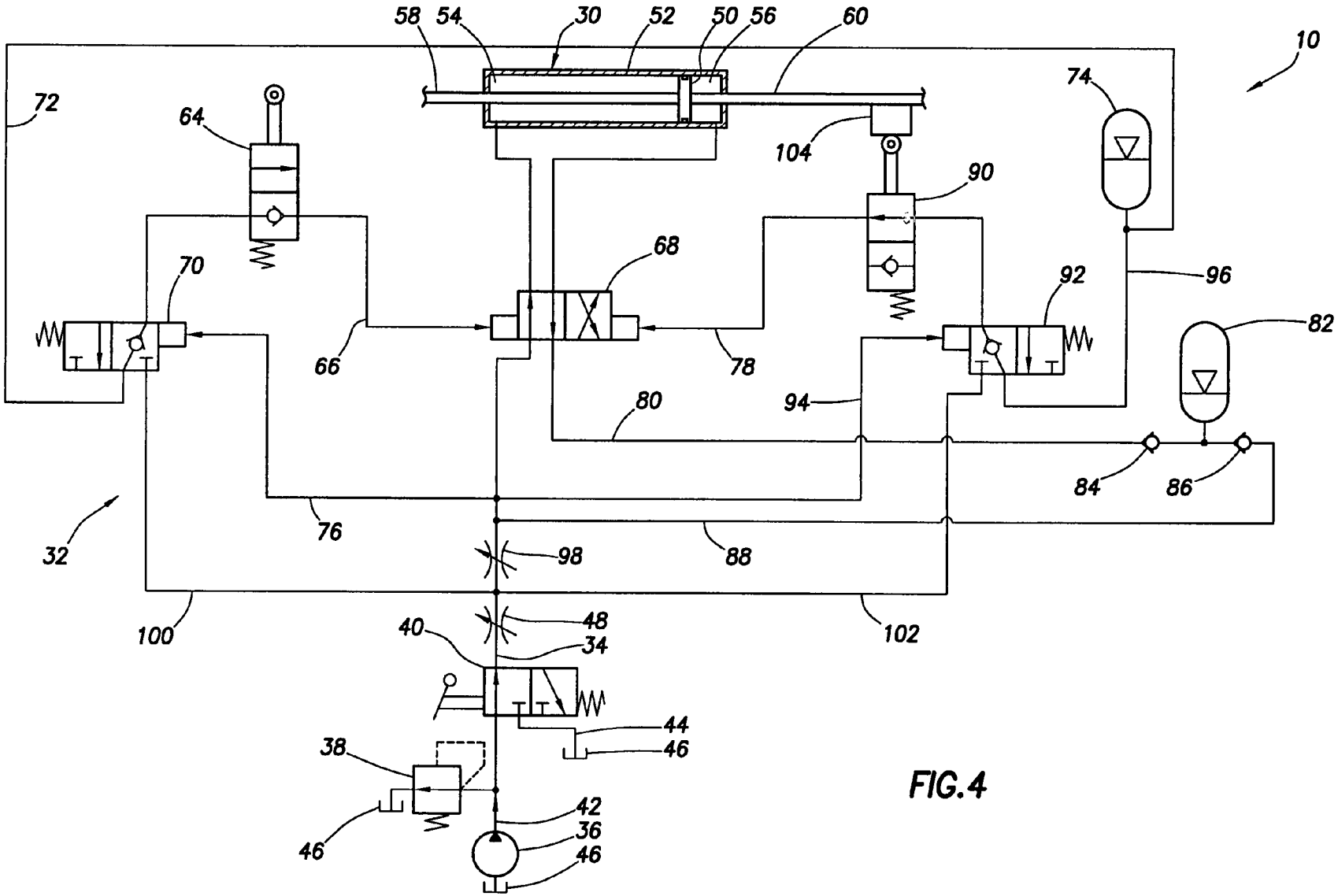

Referring additionally now to FIG. 4, the system 10 is depicted as the piston 50 approaches its fully stroked position to the right. A device 104 carried on the rod 60, similar to the device 62 described above, depresses the valve 90. As with the device 62, the device 104 may actuate the valve 90 in any manner, including mechanically, hydraulically, magnetically, electrically, optically, thermally, etc. Fluid in the chamber 56 continues to flow into the accumulator 82 via the valve 68, accumulator line 80 and check valve 84, further pressurizing the accumulator.

Figure 5:
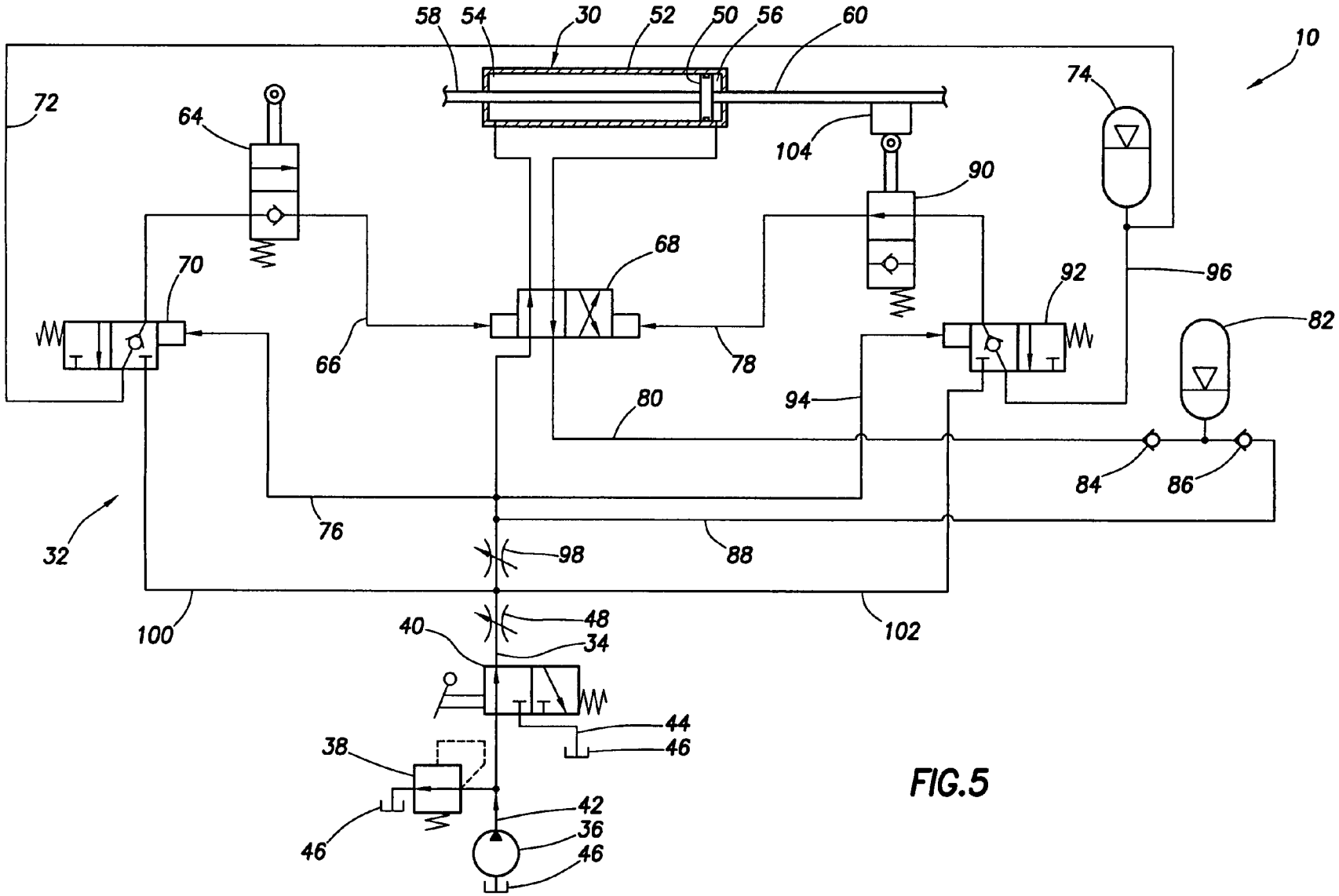

Referring additionally now to FIG. 5, the system 10 is depicted with the piston 50 at its fully stroked position to the right. This position of the piston 50 may correspond to a fully open position of the closure member 24 in the flow control device 18. The accumulator 82 is fully charged at this point.

Figure 6:
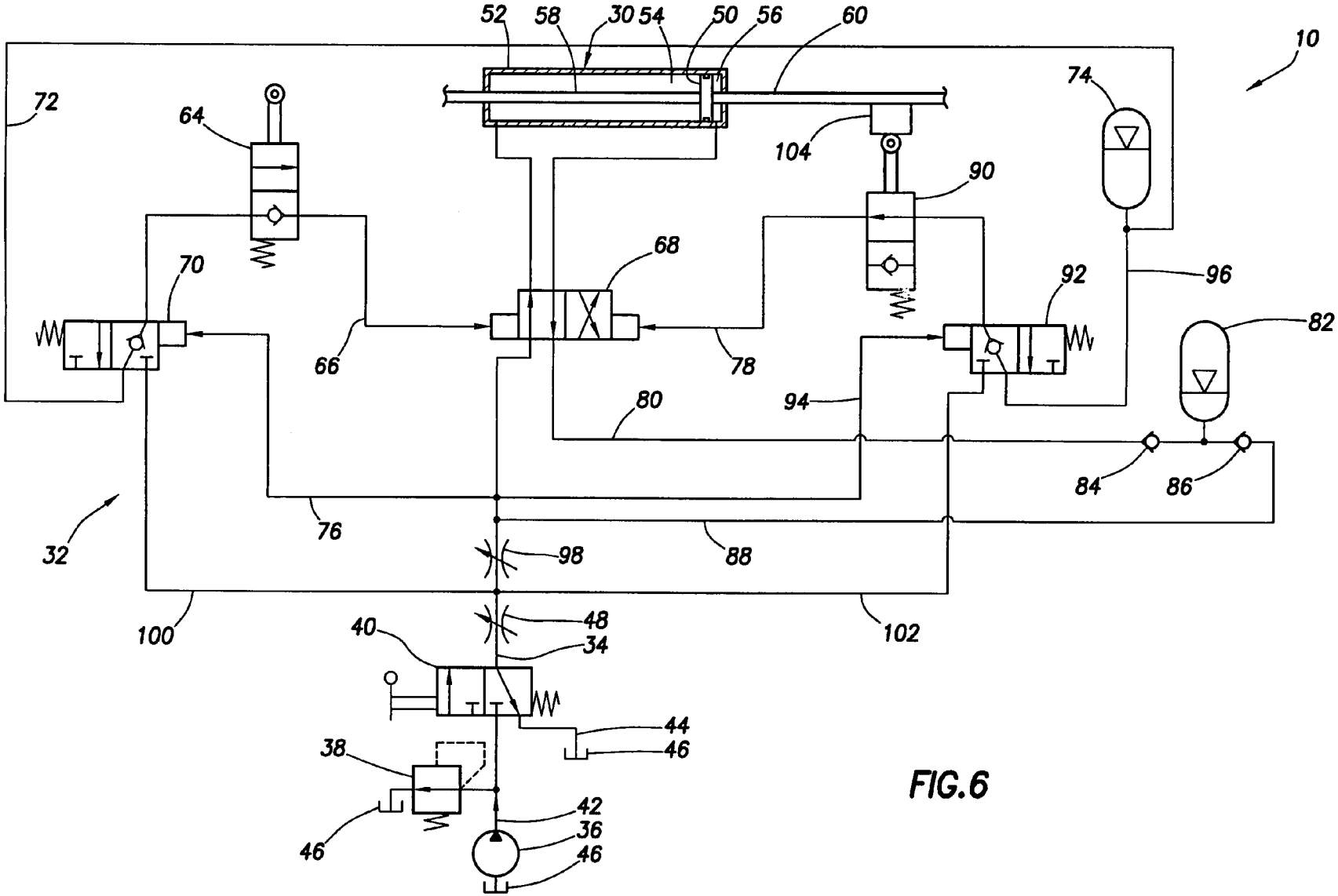

Referring additionally now to FIG. 6, the system 10 is depicted with the valve 40 shifted to disconnect the control line 34 from the input line 42 and exhaust fluid from the control line to the reservoir 46 via the exhaust line 44. The fluid stored in the pressurized accumulator 82 is exhausted via the check valve 86 and exhaust line 88 to the control line 34.

It may now be fully appreciated how the accumulator 82 operates to assist in exhausting fluid from the control module 32 and displacing the fluid up the control line 34. In this manner, the fluid does not have to be dumped to the annulus 20 or interior passage 22 downhole where hydrostatic and flowing pressures fluctuate or may be unknown beforehand, and where debris would have an opportunity to enter the control module 32.

In basic terms, operation of the actuator 30 pressurizes the accumulator 82 using fluid discharged from the actuator. Later, after the actuator 30 has been operated to a desired position, the fluid stored in the accumulator 82 is exhausted through the control line 34 using the stored pressure.

It may also now be fully appreciated how the single control line 34 is used both for delivering fluid and applying pressure to the actuator 30, and for exhausting fluid and pressure from the actuator. The use of the control line 34 in this manner reduces the number of control lines or umbilicals needed for a well, decreasing the expense of the system 10 installation, reducing the time required for the installation, decreasing the chances of a leak occurring in multiple lines, etc.

Figure 7:
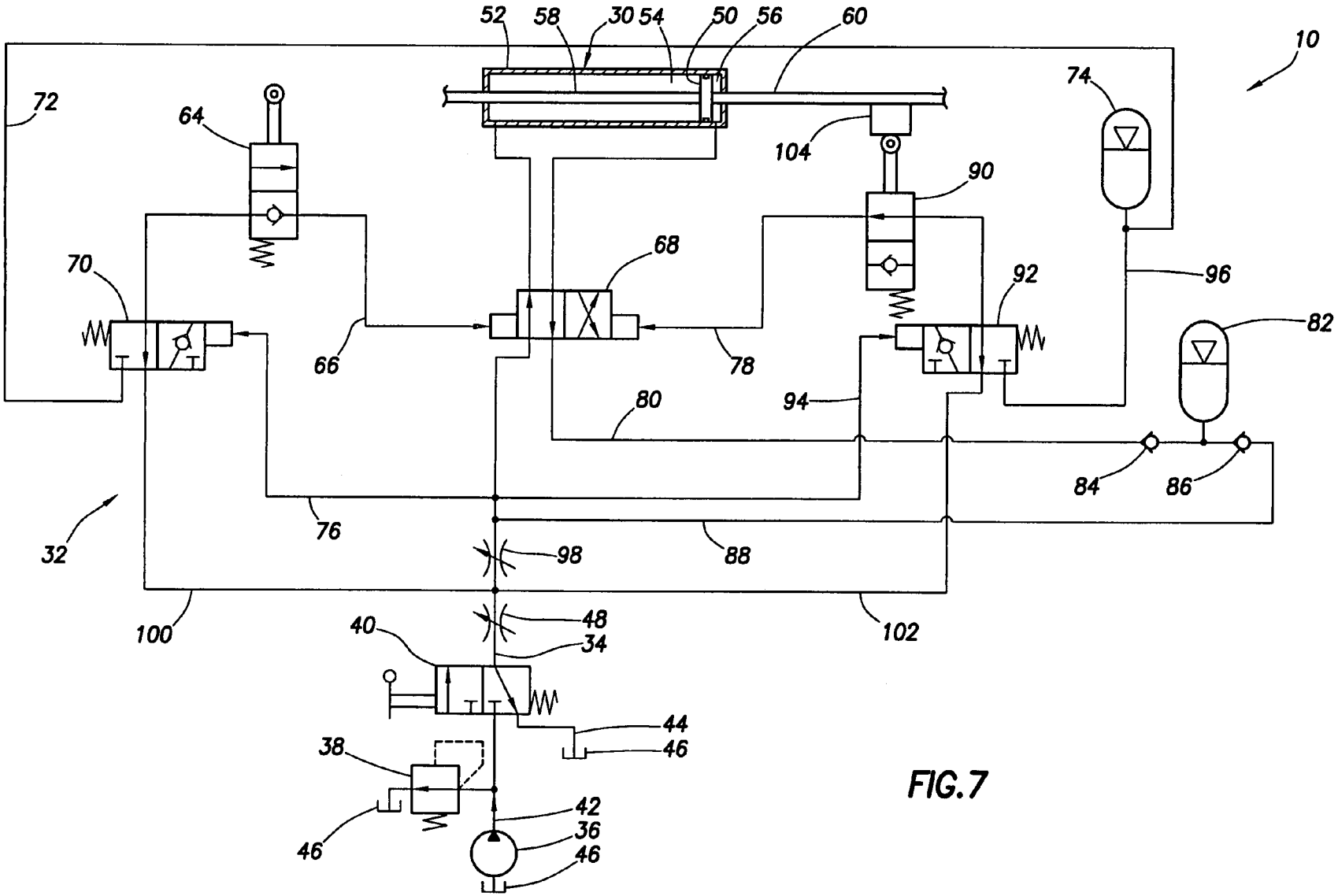

Referring additionally now to FIG. 7, the system 10 is depicted after the elevated pressure in the control line 34 has been fully exhausted. This also relieves the elevated pressure in the pilot lines 76, 94, and so the valves 70, 92 are shifted back to positions in which direct communication is provided through the valves between the respective lines 100, 102 and pilot lines 66, 78. However, the valve 64 still only permits pressure to be bled off of the pilot line 66, while the valve 90 permits pressure to be applied to the pilot line 78.

Figure 8:
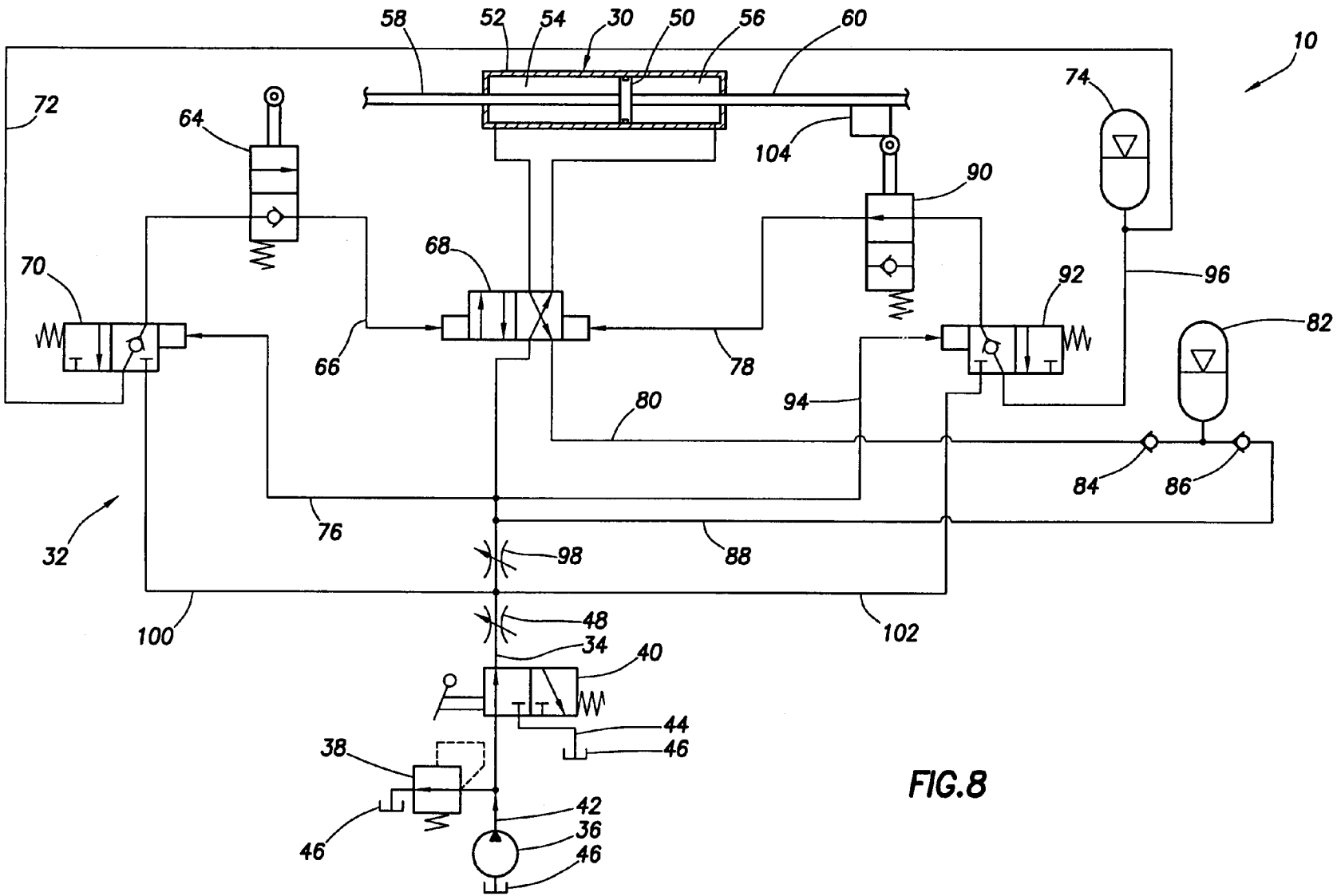

Referring additionally now to FIG. 8, the system 10 is depicted with the valve 40 shifted to connect the input line 42 to the control line 34, thereby applying increased pressure from the pump 36 to the control line. With the valve 92 positioned as shown in FIG. 7, this increased pressure is applied to the pilot line 78 via the line 102, valve 92 and valve 90, thereby shifting the valve 68. Pressure in the pilot line 66 is not increased due to a check valve in the valve 64.

The restrictor 98 delays application of the increased pressure to the pilot lines 76, 94 until after the valve 68 has shifted. When sufficient pressure is applied to the pilot lines 76, 94, the valves 70, 92 are shifted to their positions shown in FIG. 8.

With the valve 68 shifted to the position shown in FIG. 8, increased pressure in the control line 34 is communicated to the chamber 56 of the actuator 30, thereby displacing the piston 50 to the left. This leftward displacement of the piston 50 may be used to displace the closure member 24 so that a reduced rate of flow is permitted through the ports 26. Displacement of the piston 50 may be halted at any time (by shifting the valve 40 back to the position shown in FIG. 7) to position the closure member 24 as desired relative to the ports 26, for example, to permit a desired rate of flow through the ports.

This displacement of the piston 50 to the left causes fluid in the chamber 54 to be discharged from the cylinder 52 and through the valve 68, accumulator line 80 and check valve 84 to the accumulator 82. Thus, the accumulator 82 is pressurized as the piston 50 displaces to the left. Note that the accumulator 82 is pressurized with fluid discharged from the cylinder 52 both when the piston displaces to the left (as depicted in FIG. 8) and when the piston displaces to the right (as depicted in FIG. 3).

Figure 9:
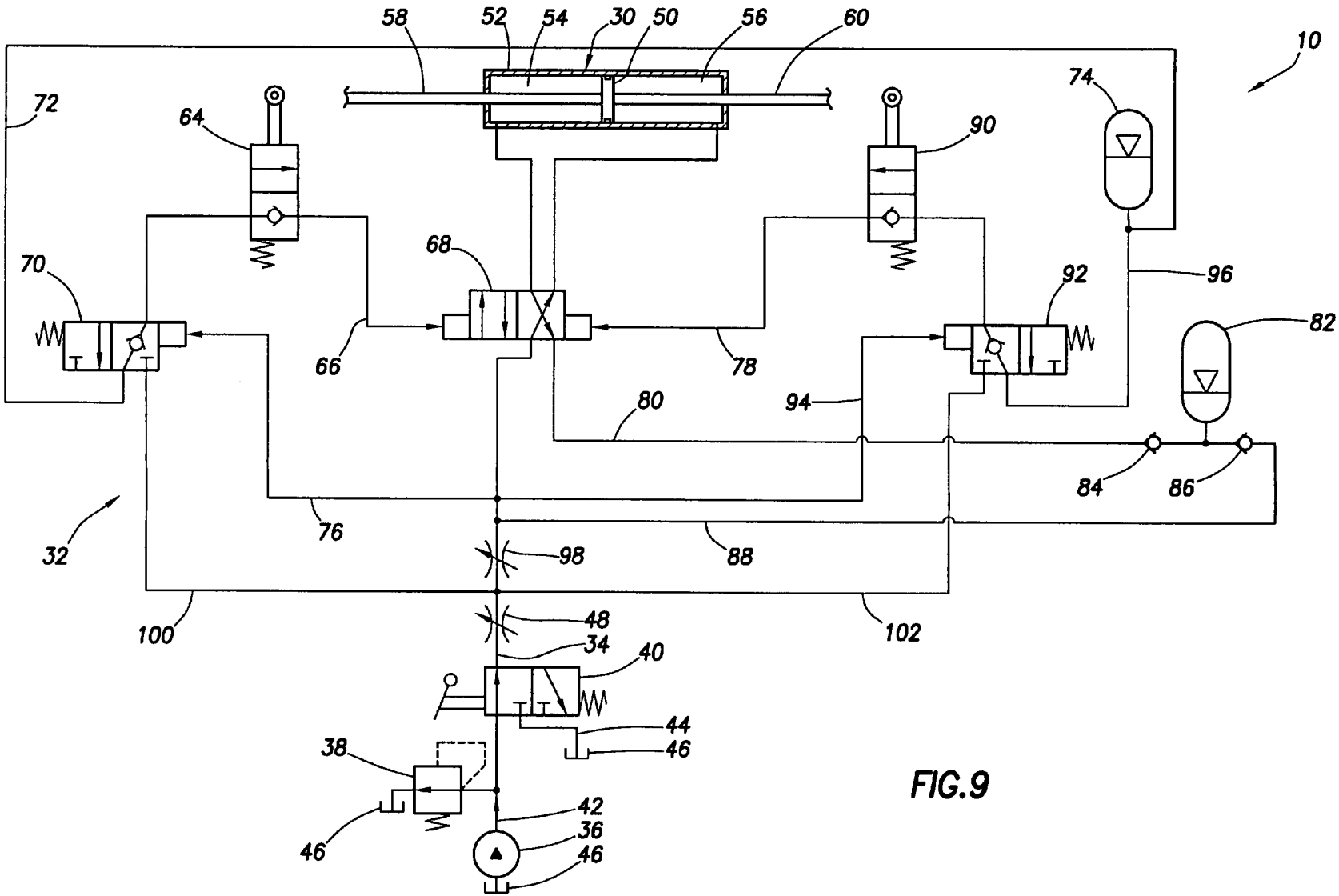

Referring additionally now to FIG. 9, the system 10 is depicted after the piston 50 has displaced sufficiently far to the left that the device 104 no longer depresses the valve 90. Both of the valves 64, 90 are now positioned so that the respective pilot lines 66, 78 may be bled off to the accumulator 74 via the accumulator lines 72, 96, but pressure may not be applied to either of the pilot lines.

Figure 10:
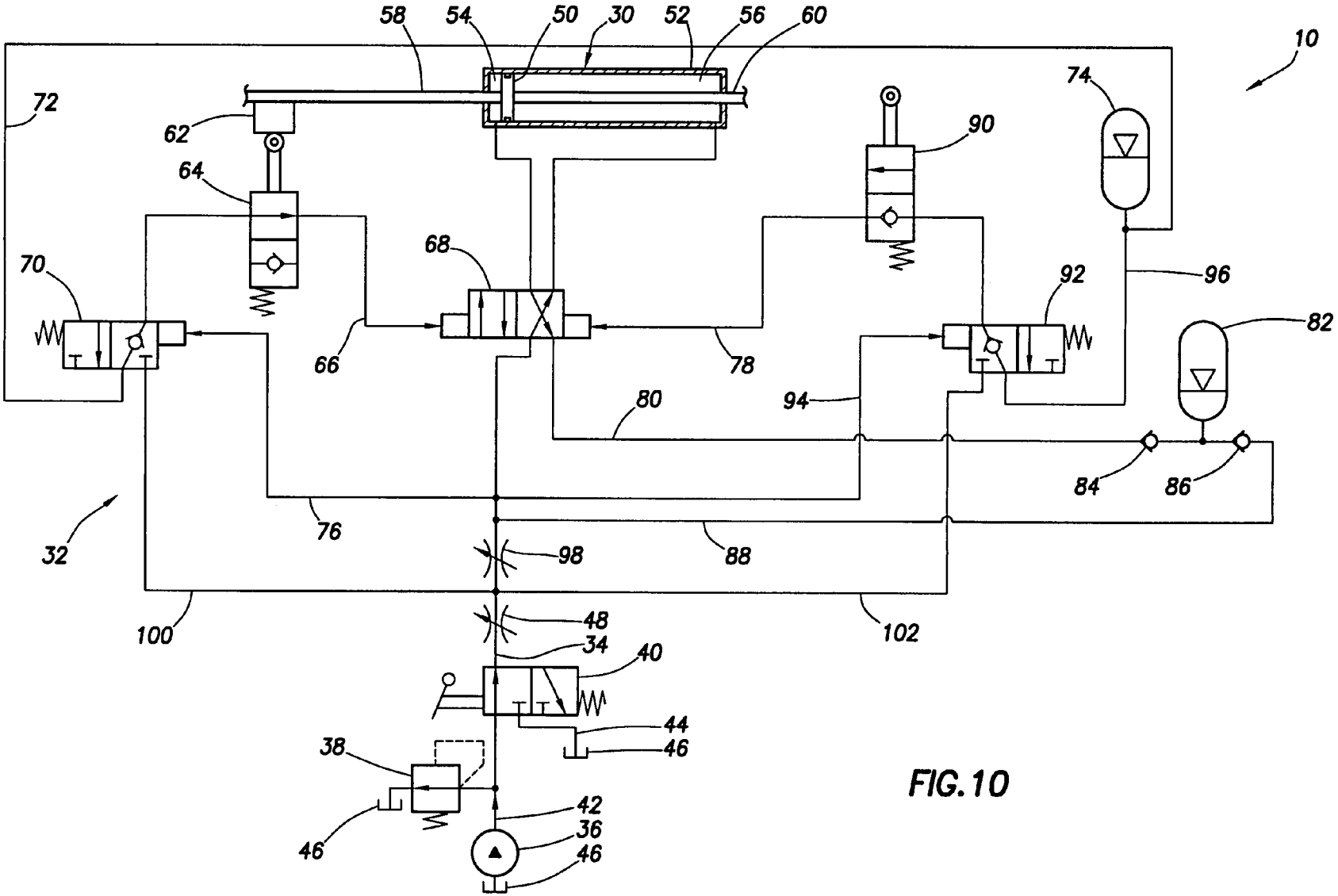

Referring additionally now to FIG. 10, the system 10 is depicted with the piston 50 displaced to its fully stroked left position. The device 62 again depresses the valve 64, permitting pressure to be applied to the pilot line 66 through the valve. However, the valve 70 still permits only flow of fluid from the pilot line 66 to the accumulator line 72.

Figure 11:
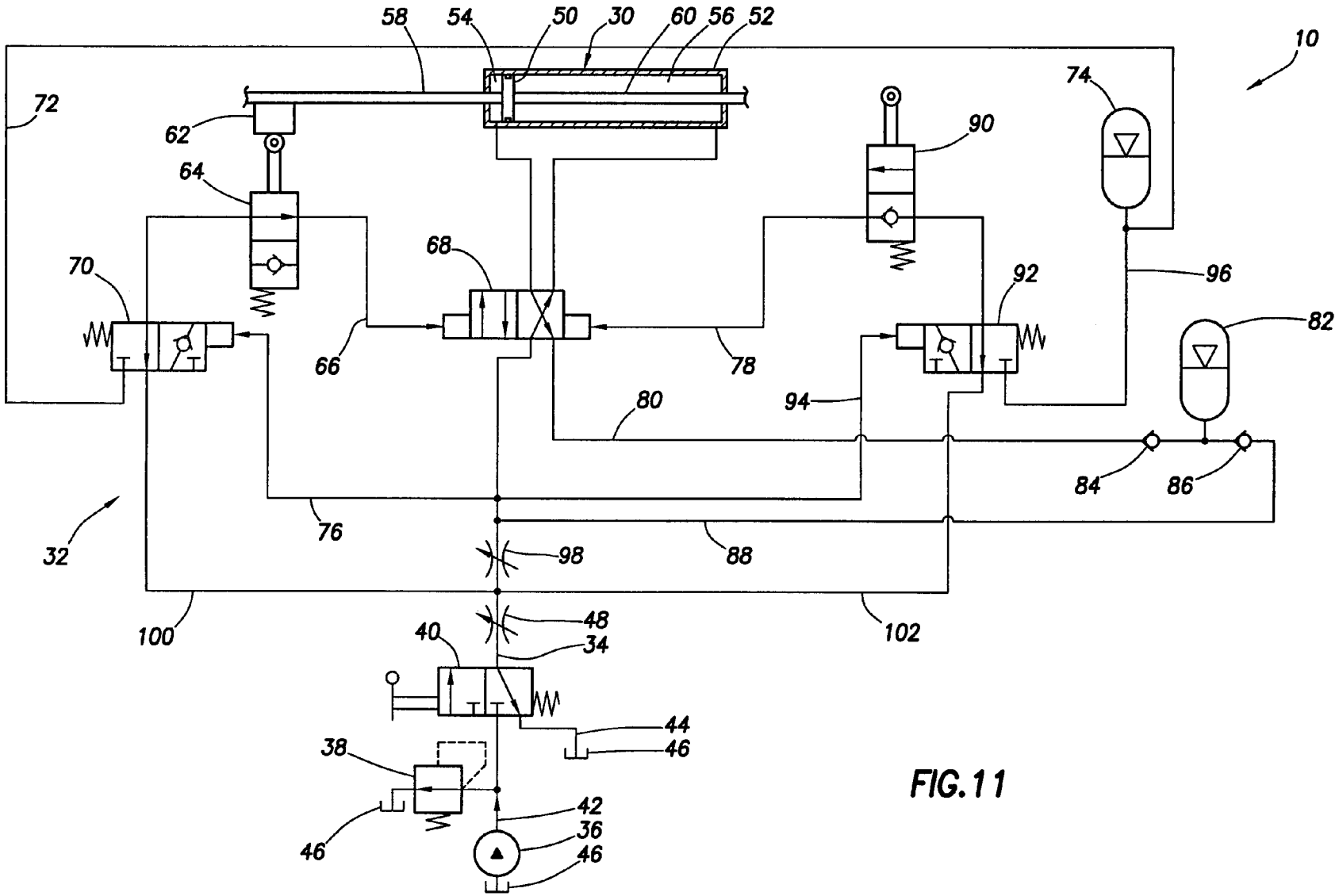

Referring additionally now to FIG. 11, the system 10 is depicted with the valve 40 shifted to disconnect the input line 42 from the control line 34, and to exhaust fluid and pressure from the control line to the reservoir 46 via the exhaust line 44. Fluid and pressure stored in the accumulator 82 may now be exhausted to the control line 34 via the check valve 86 and exhaust line 88. Thus, fluid and pressure are exhausted from the accumulator 82 both after the piston 50 has displaced to the left, and after the piston has displaced to the right.

As shown in FIGS. 2-11, the piston 50 has been displaced to the right and then back to the left by merely shifting the valve 40 back and forth. As described above, this displacement of the piston 50 may be used to displace the closure member 24 of the flow control device 18 to its fully open and fully closed positions, and to a position between the fully open and fully closed positions. Alternatively, displacement of the piston 50 may be used to operate other types of well tools. For example, instead of or in addition to the flow control device 18, the well tool 28 could include a sampler, pump, sensor, perforating device, packer, oil/water separator or other type of well tool operable by displacement of the piston 50.

Between each displacement of the piston 50, fluid stored in the accumulator 82 has been exhausted back to the reservoir 46 via the control line 34. The control line 34 is used alternately to deliver fluid to the actuator 30 to displace the piston 50 to the right and to displace the piston to the left, and to exhaust fluid from the actuator after the piston has displaced to the left and after the piston has displaced to the right.

The piston 50 may be displaced again to the right from its position depicted in FIG. 11 by shifting the valve 40 to place the input line 42 in communication with the control line 34. Increased pressure applied to the control line 34 by the pump 36 will then be communicated to the pilot line 66, thereby shifting the valve 68 so that the control line is placed in communication with the chamber 54. Then, increased pressure in the pilot lines 76, 94 will cause the valves 70, 92 to shift, and the system will be returned to the configuration depicted in FIG. 3 as the piston 50 displaces to the right. Thus, the system 10 permits the piston 50 to be displaced back and forth repeatedly as many times as is desired.

Figure 12:
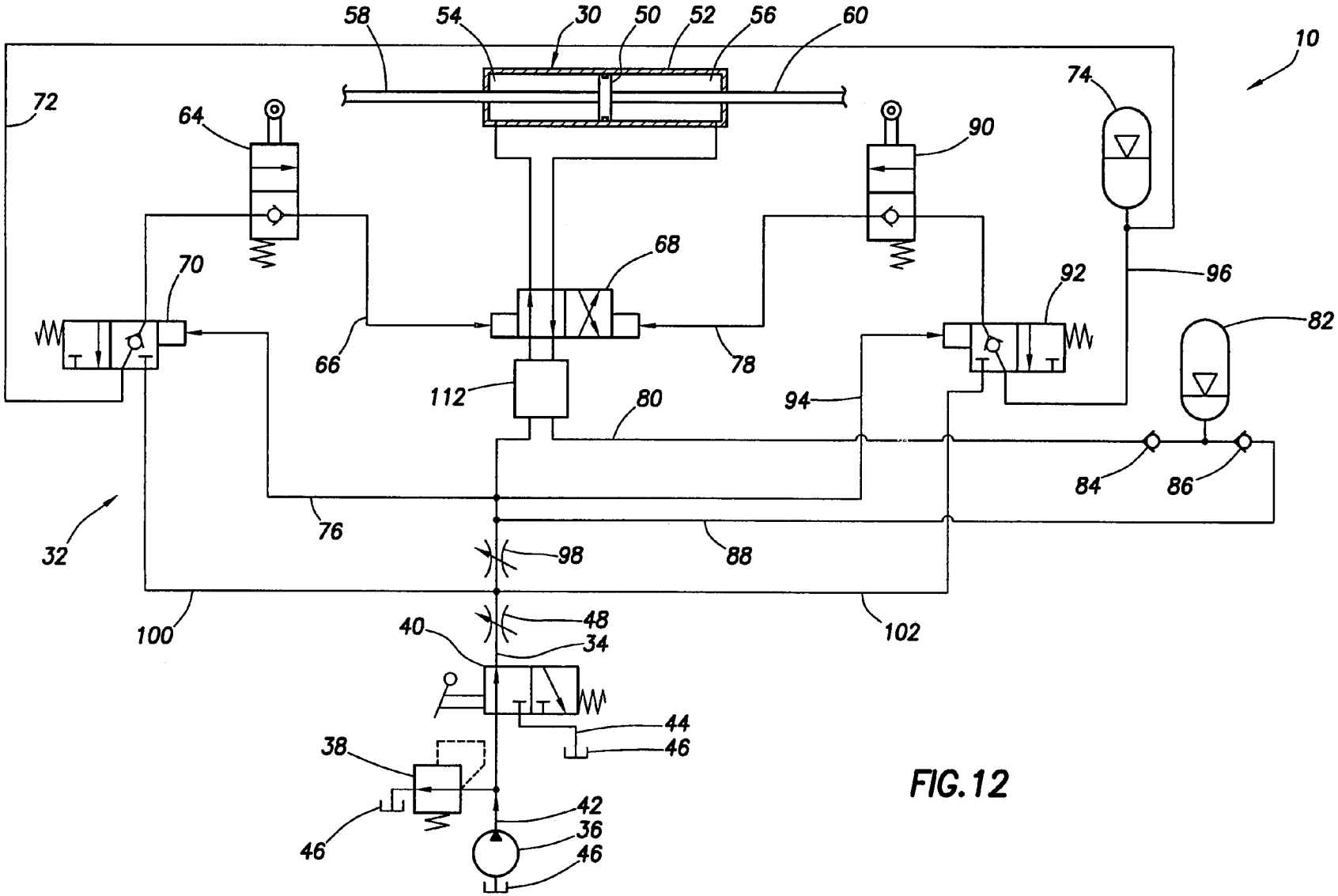
FIG. 12 is a schematic hydraulic circuit diagram of the system of FIG. 1 with an alternate configuration of the control module.

Referring additionally now to FIG. 12, the system 10 is depicted in an alternate configuration. This alternate configuration is similar to the system 10 as illustrated in FIGS. 2-11, except that a volume metering device 112 has been interconnected in the control module 32.

The volume metering device 112 enables the piston 50 to be incrementally displaced in the actuator 30. For example, an application of elevated pressure to the control line 34 (by shifting the valve 40 to the position shown in FIG. 12) will cause the elevated pressure to be applied to the device 112. In response, the device 112 discharges a predetermined volume of fluid to the chamber 54 via the valve 68, thereby displacing the piston 50 to the right a predetermined distance.

Alternatively, the device 112 may permit a predetermined volume of fluid to be discharged from the chamber 56 in response to the application of elevated pressure to the control line 34. Again, the piston 50 would be displaced to the right a predetermined distance.

If the device 112 is configured to discharge the predetermined volume of fluid to the chamber 54 in response to elevated pressure applied to the control line 34, then the device may only be interconnected in the control line 34, without also being interconnected in the accumulator line 80 as depicted in FIG. 12, and the accumulator line may be connected directly to the valve 68. Similarly, if the device 112 is configured to permit discharge of the predetermined volume of fluid from the chamber 56 in response to elevated pressure applied to the control line 34, then the device may only be interconnected in the accumulator line 80, without also being interconnected in the control line 80 as depicted in FIG. 12, and the control line may be connected directly to the valve 68.

By repeatedly applying elevated pressure to the control line 34 (e.g., by shifting the valve 40 back and forth), the predetermined volume of fluid may be repeatedly discharged to the chamber 54 from the device 112, or repeatedly discharged from the chamber 56 via the device 112, as many times as desired to produce a corresponding number of incremental displacements of the piston 50 to the right. This feature may be useful, for example, in accurately adjusting the position of the closure member 24 to produce a known flow area through the ports 26 or a known pressure drop across the ports, etc.

When the piston 50 has displaced fully to the right and the valve 68 has been shifted by pressure applied to the control line 34 (similar to the configuration depicted in FIG. 8), then the device 112 will operate to discharge the predetermined volume of fluid to the chamber 56, or to permit the predetermined volume of fluid to be discharged from the chamber 54. Again, the elevated pressure may be applied to the control line 34 repeatedly to produce a desired number of incremental predetermined displacements of the piston 50 to the left. Thus, by using the device 112 in the control module 32, incremental predetermined displacements of the piston 50 to the right and to the left may be accomplished.

The device 112 may be any type of volume metering device. For example, any of the devices described in U.S. Pat. No. 6,585,051 may be used, e.g., to discharge a predetermined volume of fluid from the control line 34 to the chamber 54 or chamber 56 of the actuator 30. As another example, the device described in U.S. application Ser. No. 10/643,488 filed Aug. 19, 2003 may be used, e.g., to permit discharge of a predetermined volume of fluid from the chamber 54 or chamber 56 of the actuator 30 to the accumulator line 80. The entire disclosures of the U.S. patent and application mentioned above are incorporated herein by this reference.

Figure 13:
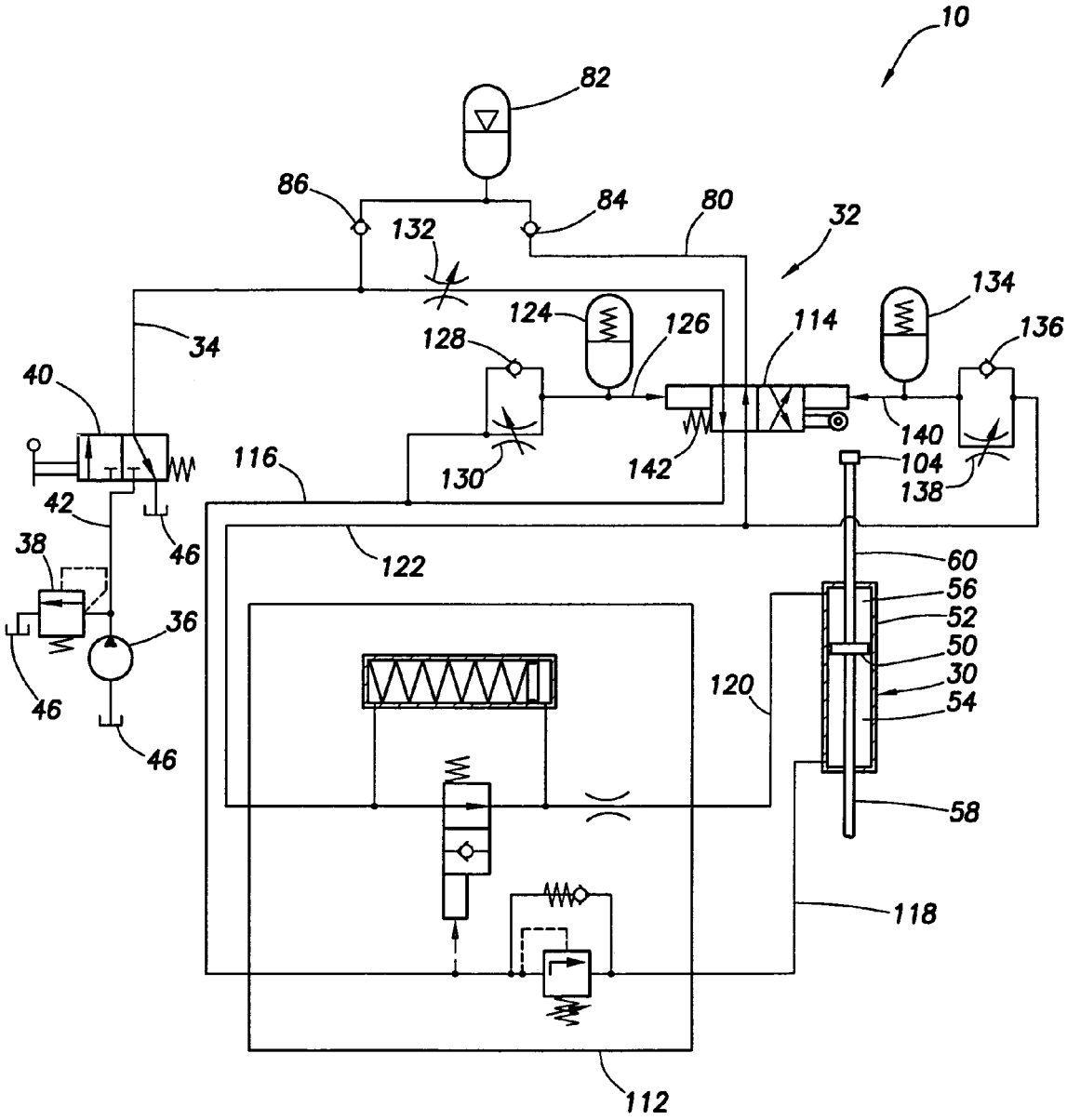
FIG. 13 is a schematic hydraulic circuit diagram of the system of FIG. 1 with a second alternate configuration of the control module.

Referring additionally now to FIG. 13, the system 10 is depicted in another alternate configuration. This alternate configuration is similar in many respects to the other configurations described above, and so similar components are indicated in FIG. 13 using the same reference numbers.

As with the configuration depicted in FIG. 12, the volume metering device 112 is used in the configuration depicted in FIG. 13 to regulate the volume of fluid transferred between the control module 32 and the actuator 30. In this case, the volume metering device 112 is used to meter the volume of fluid discharged from the chamber 56 of the actuator. That is, each time elevated pressure is applied via the control line 34 and volume metering device 112 to the chamber 54, the volume metering device permits only a predetermined volume of fluid to be discharged from the chamber 56, thereby causing the piston 50 to displace a predetermined incremental distance upward as viewed in FIG. 13.

In this manner (i.e., permitting discharge of a predetermined volume of fluid from an actuator in response to each of multiple pressure applications to the actuator), the volume metering device 112 as depicted in FIG. 13 is similar to the volume metering device described in the U.S. application Ser. No. 10/643,488 referred to above. However, other types of volume metering devices (such as any of the volume metering devices described in U.S. Pat. No. 6,585,051) may be used in keeping with the principles of the invention.

As depicted in FIG. 13, the control line 34 is vented to the reservoir 46 by the valve 40. To operate the actuator 30, the valve 40 is actuated to connect the input line 42 to the control line 34, thereby applying elevated pressure from the pump 36 to the control line. The elevated pressure is applied to the chamber 54 of the actuator 30 via a valve 114, a line 116 connected between the valve and the volume metering device 112, and another line 118 connected between the volume metering device and the actuator.

The elevated pressure is transmitted via the piston 50 to the other chamber 56 of the actuator 30. The chamber 56 is connected to the volume metering device 112 via another line 120. The volume metering device 112 permits a certain volume of fluid to be discharged from the line 120 (and, thus, from the chamber 56) to another line 122 connected between the volume metering device and the valve 114. As the volume of fluid is discharged from the chamber 56, the piston 50 displaces upward a known incremental distance.

The fluid discharged into the line 122 is used to charge the accumulator 82 via the valve 114 and the check valve 84. When the valve 40 is returned to its position as shown in FIG. 13, elevated pressure stored in the accumulator 82 is vented to the reservoir 46 via the check valve 86 and control line 34.

This completes one cycle of incremental upward displacement of the piston 50. Additional upward displacements of the piston 50 may be performed by alternately applying elevated pressure to the control line 34, and then venting the control line as described above.

Note that an accumulator 124 is connected to a pilot line 126 of the valve 114. The pilot line 126 is connected to the line 116 via a parallel-connected check valve 128 and restrictor 130. When elevated pressure is applied to the line 116 (such as when the piston 50 is being displaced upward as described above), the check valve 128 permits unimpeded flow from the line 116 to the pilot line 126. This acts to charge the accumulator 124 and maintain the valve 114 in the position as shown in FIG. 13.

When pressure in the line 116 is vented (such as when the control line 34 is vented after displacement of the piston 50), the restrictor 130 delays venting of the pressure in the pilot line 126. This acts to maintain the valve 114 in the position as shown in FIG. 13 until after the control line 34 has been fully vented. The accumulator 124 aids in maintaining elevated pressure in the pilot line 126.

Another accumulator 134, check valve 136 and restrictor 138 are similarly connected between another pilot line 140 of the valve 114 and the line 122. The accumulator 134, check valve 136 and restrictor 138 serve a purpose similar to that of the accumulator 124, check valve 128 and restrictor 130 described above, in that they delay venting of elevated pressure on the pilot line 140.

Another restrictor 132 connected between the control line 34 and the valve 114 ensures that pressure venting from the line 116 is delayed relative to pressure venting from the line 122. Thus, when elevated pressure has been applied to the control line 34 to displace the piston 50 incrementally upward, the accumulator 124 will be charged by the pressure in the line 116, the accumulator 134 will be charged by the pressure in the line 122, and the accumulator 82 will be charged by the pressure in the line 80 (which should be the same as the pressure in the line 122, but which may be somewhat less than the pressure in the line 116).

The two sets of accumulators 124, 134, check valves 128, 136 and restrictors 130, 138 form two respective time delay circuits which serve purposes in addition to those described above. The time delay circuits allow the volume metering device 112 to "recock" at the conclusion of each pressure application cycle. In addition, the time delay circuits temporarily maintain back pressure on the restrictor 132, so that the accumulator 82 will discharge fluid through the control line 34 toward the reservoir 46.

When the piston 50 has been displaced upward a sufficient distance, the device 104 will engage the valve 114. When the control line 34 pressure is subsequently reduced and the time delay circuits have bled off the increased pressure, valve 114 will shift and to a position in which the control line 34 is connected to the line 122, and the accumulator line 80 is connected to the line 116.

When the valve 40 is then actuated to vent the control line 34, the line 122 will be vented via the valve 114 and the restrictor 132. The accumulator 82 will be vented (along with the accumulator line 80 and line 116 via the valve 114) via the check valve 86 to the control line 34. Note that the venting of the line 122 will now be delayed relative to venting of the line 116, thereby ensuring that pressure in the pilot line 140 remains elevated relative to pressure in the pilot line 126, and thus maintaining the valve 114 in its shifted position.

The valve 40 can then be actuated to connect the input line 42 to the control line 34 and thereby apply elevated pressure to the line 122 via the valve 114. When pressure in the line 122 is greater than pressure in the line 116, the volume metering device 112 permits an unlimited volume of fluid to be discharged to the line 120. Thus, the piston 50 will be displaced to its fully downward stroked position in response to the application of elevated pressure to the line 122.

As the piston 50 strokes downward, fluid is discharged from the chamber 54 to the line 118. This fluid is used to charge the accumulator 82 via the line 116, valve 114 and accumulator line 80. When the valve 40 is returned to its position as shown in FIG. 13 to vent the control line 34, pressure stored in the accumulator 82 will be vented to the control line via the check valve 86.

The lines 116, 122 will also be vented when the control line 34 is vented. The restrictor 132 will ensure that the pressure in the line 122 remains elevated relative to that in the line 116 as the lines are being vented. In addition, the accumulator 134 will maintain a somewhat greater pressure on the pilot line 140 as compared to that maintained on the pilot line 126 by the accumulator 124, thereby ensuring that the valve remains in its shifted position as the lines 116, 122 are being vented.

Eventually, the lines 34, 80, 116, 122 will be fully vented. At that point (or just prior), a biasing device 142 will shift the valve 114 back to its initial position as shown in FIG. 13. The system 10 is then ready to again incrementally displace the piston 50 upward by alternately applying elevated pressure to, and venting, the control line 34 by actuating the valve 40 back and forth.

It may now be fully appreciated that the actuator 30 may be conveniently operated using the control module 32 and only a single control line 34 extending to the valve 40 at the remote location. The piston 50 may be incrementally displaced upward (for example, to position a downhole choke so that a desired flow rate or pressure drop is achieved) by alternately applying and venting elevated pressure on the control line 34. The actuator 30 may be reset (i.e., the piston 50 displaced back to its fully stroked downward position) by displacing the piston to its fully upward stroked position, venting the control line 34, and then applying elevated pressure to the control line to stroke the piston fully downward, and again venting the control line. At that point, the piston 50 can again be incrementally displaced upward by alternately applying and venting elevated pressure on the control line 34.

Figure 14:
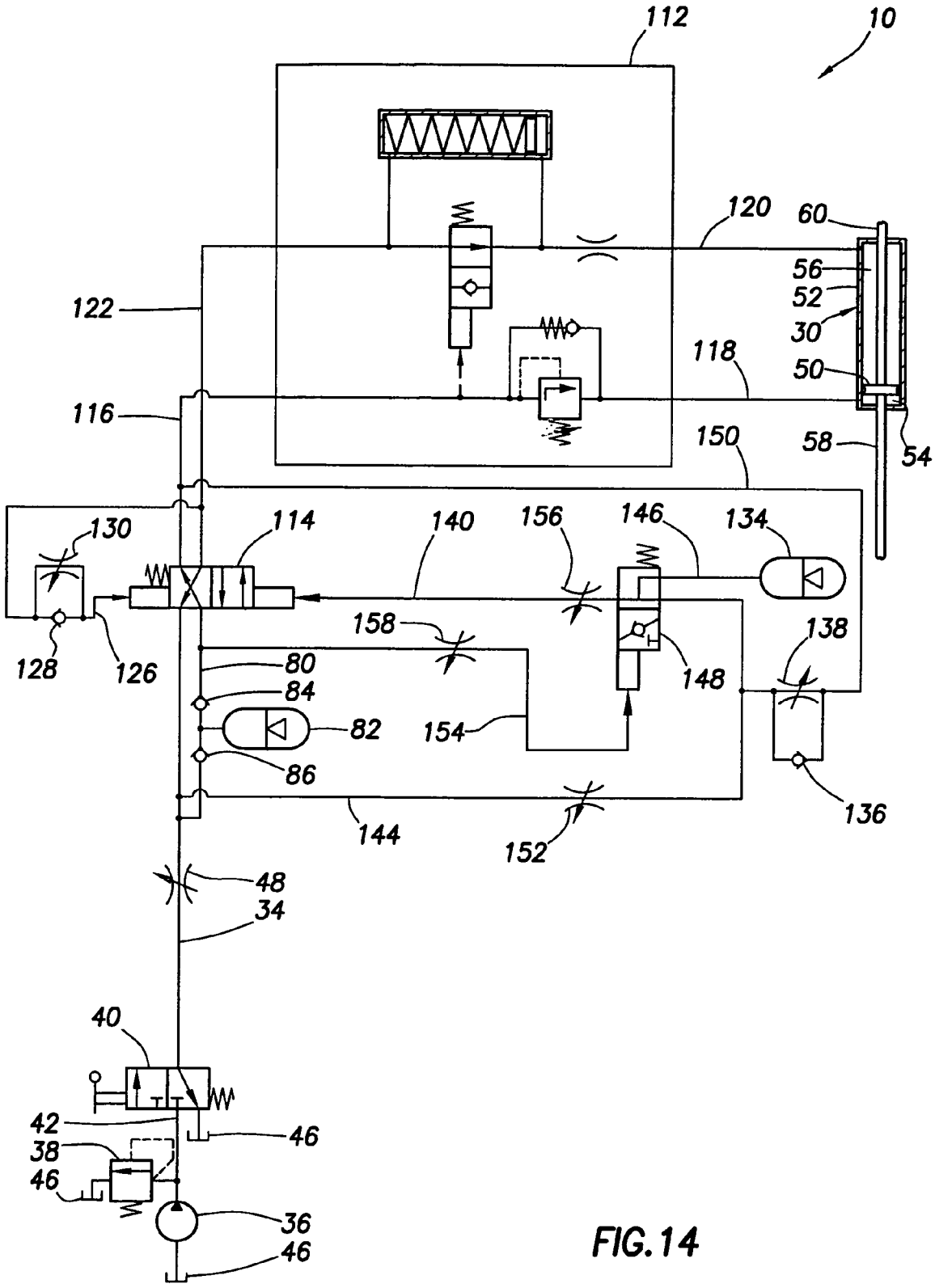
FIG. 14 is a schematic hydraulic circuit diagram of the system of FIG. 1 with a third alternate configuration of the control module.

Referring additionally now to FIG. 14, the system 10 is depicted in another alternate configuration. This alternate configuration is similar in many respects to the other configurations described above, and so similar components are indicated in FIG. 14 using the same reference numbers.

The configuration depicted in FIG. 14 is most similar to the configuration depicted in FIG. 13, in that the volume metering device 112 is used to permit discharge of a predetermined volume of fluid from the chamber 56 when increased pressure applied to the control line 34 displaces the piston 50 upward. However, one difference is that actuation of the valve 114 in the configuration shown in FIG. 14 is not dependent at all upon displacement of the piston 50. Instead, the valve 114 is biased toward the position shown in FIG. 14, and is also pilot operated by pressures in the pilot lines 126, 140. Thus, pressure in the pilot line 140 must exceed pressure in the pilot line 126 by a predetermined amount for the valve 114 to shift from its position shown in FIG. 14.

The piston 50 is at its lowermost position as depicted in FIG. 14. To displace the piston 50 incrementally upward, the valve 40 is shifted to apply pressure from the pump 36 to the control line 34. Elevated pressure in the control line 34 is communicated to the accumulator 134 via lines 144, 146 and a spring biased pilot operated valve 148. The accumulator 134 stores this elevated pressure therein.

Note that, at this point the valve 114 is in a position such that the elevated pressure in the control line 34 is communicated to the line 122, which communicates with the actuator chamber 56 via the volume metering device 112 and line 120. The elevated pressure in the control line 34 is also communicated to the line 116 (which communicates with the actuator chamber 54 via the volume metering device 112 and line 118) via the line 144 and another line 150. However, restrictor 138 in the line 150, and another restrictor 152 in the line 144 delay pressure buildup in the line 116 relative to that in the line 122, and so the piston 50 is not permitted to displace upward.

The valve 40 is then shifted to bleed off the control line 34 to the reservoir 46. The restrictor 152 delays the venting of pressure from the accumulator 134. The pilot line 140 is connected to the accumulator line 146 via the valve 148, and so this delay in venting pressure from the accumulator 134 causes pressure in the pilot line 140 to exceed pressure in the pilot line 126 by an amount sufficient to shift the valve 114.

Thus, upon venting the control line 34 the valve 114 is shifted and the control line 34 is placed in communication with the line 116 via the valve 114. The valve 40 may then be shifted to again apply elevated pressure to the control line 34, which will be communicated via the volume metering device 112 to the chamber 54, causing the piston 50 to displace upward, and causing a predetermined volume of fluid to be discharged from the chamber 56 via the volume metering device to the line 122. Fluid discharged from the chamber 56 is communicated to the accumulator 82 via the lines 122, 80, valve 114 and check valve 84.

The valve 40 may be shifted alternately back and forth to alternately vent and apply elevated pressure to the control line 34 and thereby incrementally displace the piston 50 upward. As the piston 50 displaces upward, fluid discharged from the chamber 56 pressurizes the accumulator 82 via the line 122, valve 114, line 80 and check valve 84. This increased pressure in the accumulator line 80 is also communicated to a pilot line 154 of the valve 148, thereby shifting the valve so that the pilot line 140 is disconnected from the line 144 and placing a check valve of the valve 148 between the accumulator line 146 and the pilot line 140. Thus, pressure in the pilot line 140 is prevented from bleeding off sufficiently for the valve 114 to shift back to its position as depicted in FIG. 14 as the valve 40 is shifted alternately back and forth to displace the piston 50 incrementally upward.

Eventually, the piston 50 will reach its uppermost position. At this point, the valve 40 will be shifted to vent the control line 34 to the reservoir 46.

After a sufficient amount of time, the accumulators 82, 134 will be completely bled off via the control line 34. When the pressure in the pilot line 140 is no longer sufficiently greater than the pressure in the pilot line 126, the valve 114 will shift back to its position as shown in FIG. 14. Note that in this position the control line 34 is again placed in communication with the line 122 via the valve 114.

The valve 40 is then shifted to place the pump 36 in communication with the control line 34, thereby applying elevated pressure to the control line. This elevated pressure is transmitted to the line 122, through the volume metering device 112, through the line 120 and to the chamber 56. The piston 50 is thereby displaced downward to its position as illustrated in FIG. 14.

Fluid discharged from the chamber 54 as the piston 50 displaces downward pressurizes the accumulator 82 via the line 118, volume metering device 112, line 116, valve 114, line 80 and check valve 84. This increased pressure in the accumulator line 80 is also communicated to the pilot line 154 of the valve 148, thereby shifting the valve so that the pilot line 140 is disconnected from the line 144 and placing a check valve of the valve 148 between the accumulator line 146 and the pilot line 140. This prevents increased pressure from being applied to the pilot line 140 and thereby prevents the valve 114 from shifting as the piston 50 displaces downward.

When the valve 40 is then shifted to vent the control line 34 to the reservoir 46, the pressure stored in the accumulator 82 is vented via the check valve 86 to the control line. As pressure in the line 154 bleeds off, the valve 148 shifts back to its position as illustrated in FIG. 14, thereby allowing the accumulator 134 to be vented to the control line 34 also.

Thus, the piston 50 has completed a complete cycle described above of displacing incrementally upward, and then displacing downward back to its initial position as depicted in FIG. 14. Of course, the hydraulic circuit could be modified so that the piston 50 displaces incrementally downward (or in any other direction, such as leftward or rightward, etc.) instead of incrementally upward. For example, the valve 114 could be reversed, so that the control line 34 is placed in communication with the line 116 when the system is completely vented.

Furthermore, any other volume metering device could be used in place of the device 112 shown in FIG. 14. In addition, it is not necessary for the volume metering device 112 to be used at all, for example, if it is not desired to incrementally displace the piston 50, in which case the line 116 could be connected directly to the line 118 and the line 122 could be connected directly to the line 120.

Note that if the piston 50 is midway between its uppermost and lowermost positions when the control line 34 is vented completely and the accumulators 82, 134 are completely bled off to hydrostatic pressure, then when elevated pressure is again applied to the control line 34 (by shifting the valve 40), the piston 50 will initially displace downward somewhat (since the valve 114 will connect the control line 34 to the line 122). However, as soon as pressure in the pilot line 140 increases sufficiently to shift the valve 114, the piston 50 can continue its incremental upward displacement in response to alternately shifting the valve 40 back and forth to alternately pressurize and vent the control line 34 as described above.

A restrictor 156 in the pilot line 140 between the valves 114 and 148 functions to delay venting or bleed off of the line, thereby maintaining elevated pressure in the line for an extended time. In this manner, the pilot line 140 can be charged at any time in the actuation cycle, and when the control line 34 is vented the pilot line 140 venting is delayed. This allows the valve 114 to be switched (with an appropriate time delay), so the actuator 30 can be properly operated.

A restrictor 158 in the pilot line 154 between the accumulator line 80 and the valve 148 functions to delay switching of the valve as pressure in the line increases. This prevents undesirable switching back and forth of the valve 148 when the pilot line 154 is at approximately the pressure required to actuate the valve. The restrictor 158 also ensures that the pilot line 140 and accumulator 134 are sufficiently pressurized before the valve 148 switches, so that switching of the valve 114 is consistent.

Note that additional restrictors, valves, accumulators, etc. could be included in any of the hydraulic circuits described above as desired to refine their operation. Furthermore, other circuit elements or combinations of elements could be substituted for those described above, without departing from the principles of the invention.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A well tool control system, comprising:

an actuator;

a control module for controlling pressure applied to the actuator; and a single line extending between the control module and a remote location, a single predetermined minimum elevated pressure being applied to the line and exhausted from the line at the remote location to operate the control module.

2. A well tool control system, comprising:

an actuator;

a control module for controlling pressure applied to the actuator; and a single line extending between the control module and a remote location, elevated pressure being applied to the line and exhausted from the line at the remote location to operate the actuator, wherein the actuator includes a piston separating first and second chambers, the first chamber being connected to the line and the second chamber being connected to an accumulator of the control module when elevated pressure is applied to the line to displace the piston relative to the first and second chambers in a first direction, and the second chamber being connected to the line and the first chamber being connected to the accumulator when elevated pressure is applied to the line to displace the piston relative to the first and second chambers in a second direction opposite to the first direction.

3. The system of claim 2, wherein fluid stored in the accumulator is exhausted to the line when elevated pressure is exhausted from the line at the remote location.

4. The system of claim 2, wherein pressure in the accumulator is bled off to the line when elevated pressure is exhausted from the line at the remote location.

5. The system of claim 2, wherein the control module further includes a first valve which alternately connects the first and second chambers to the accumulator.

6. The system of claim 5, wherein the first valve is operated in response to pressure in the line.

7. The system of claim 5, wherein the control module further includes a second valve connected to a pilot line of the first valve.

8. The system of claim 7, wherein the second valve is operated in response to displacement of the piston relative to the first and second chambers.

9. A well tool control system, comprising:

an actuator including first and second chambers;

a line for applying elevated pressure to the actuator to operate the actuator; and a control module including an accumulator, and a first valve having a first position in which the line is connected to the first chamber and the accumulator is connected to the second chamber, and a second position in which the line is connected to the second chamber and the accumulator is connected to the first chamber.

10. The system of claim 9, wherein the system includes only the single line connected between the control module and a remote location.

11. The system of claim 10, wherein the line is used both for applying elevated pressure to the actuator and for exhausting fluid from the accumulator.

12. The system of claim 9, wherein the actuator further includes a piston separating the first and second chambers, and wherein the piston displaces in a first direction relative to the first and second chambers when the first valve is in the first position, and the piston displaces in a second direction opposite to the first direction relative to the first and second chambers when the first valve is in the second position.

13. The system of claim 9, wherein fluid from the second chamber is discharged to the accumulator when elevated pressure is applied to the first chamber, and wherein fluid from the first chamber is discharged to the accumulator when elevated pressure is applied to the second chamber.

14. The system of claim 13, wherein fluid is discharged from the accumulator to the line when elevated pressure is not applied to the line.

15. The system of claim 9, wherein the control module further includes a second valve connected to a pilot line of the first valve, the second valve being operated in response to displacement of a piston of the actuator relative to the first and second chambers.

16. A well tool control system, comprising:

an actuator including a piston separating first and second chambers, the actuator operating by relative displacement between the piston and the first and second chambers; and a control module which connects the first chamber to a source of elevated pressure in response to relative displacement of the piston in a first direction, and which connects the second chamber to the source of elevated pressure in response to relative displacement of the piston in a second direction opposite to the first direction.

17. The system of claim 16, wherein a single line connects the source of elevated pressure to the control module.

18. The system of claim 17, wherein the line is used to alternately exhaust fluid from the control module and apply elevated pressure to the control module.

19. The system of claim 16, wherein the first chamber is connected to an accumulator of the control module when the second chamber is connected to the source of elevated pressure, and wherein the second chamber is connected to the accumulator when the first chamber is connected to the source of elevated pressure.

20. The system of claim 16, wherein the control module further includes a volume metering device which causes an incremental relative displacement of the piston in response to each of multiple elevated pressures being applied to the control module.

* * * * *